US009631545B2

(12) United States Patent
Valfridsson

(10) Patent No.: US 9,631,545 B2
(45) Date of Patent: Apr. 25, 2017

(54) COOLANT CIRCUIT MANIFOLD FOR A TRACTOR-TRAILER TRUCK

(75) Inventor: Hans Fredric Valfridsson, High Point, NC (US)

(73) Assignee: VOLVO GROUP NORTH AMERICA, LLC, Greensboro, NC (US)

( * ) Notice: Subject to any disclaimer, the term of this patent is extended or adjusted under 35 U.S.C. 154(b) by 389 days.

(21) Appl. No.: 14/346,077

(22) PCT Filed: Oct. 12, 2011

(86) PCT No.: PCT/US2011/055925

§ 371 (c)(1),
(2), (4) Date: Mar. 20, 2014

(87) PCT Pub. No.: WO2013/055324

PCT Pub. Date: Apr. 18, 2013

(65) Prior Publication Data

US 2014/0224449 A1 Aug. 14, 2014

(51) Int. Cl.
*F01P 9/00* (2006.01)
*F01P 3/12* (2006.01)
(Continued)

(52) U.S. Cl.
CPC ..... *F01P 3/12* (2013.01); *F01N 3/0234* (2013.01); *F01N 5/02* (2013.01); *F01P 9/00* (2013.01); *F01P 11/04* (2013.01)

(58) Field of Classification Search
CPC ..... F01P 2060/04; F01P 2005/105; F01P 2050/12; F01P 2060/02; F01P 2060/16;
(Continued)

(56) References Cited

U.S. PATENT DOCUMENTS 2,821,272 A * 1/1958 Eames ..... B60T 13/18 137/339
4,284,037 A 8/1981 Kasting et al.
(Continued)

FOREIGN PATENT DOCUMENTS

DE 3739961 A * 6/1988 ..... F02M 31/10
EP 2192280 A1 * 6/2010 ..... F01N 3/043
(Continued)

OTHER PUBLICATIONS

EP 0301959 A1—english translation.*
International Search Report for corresponding International Application PCT/US2011/055925.

*Primary Examiner* — Marguerite McMahon
*Assistant Examiner* — Tea Holbrook
(74) *Attorney, Agent, or Firm* — Martin Farrell; Michael Pruden

(57) ABSTRACT

A tractor-trailer truck engine coolant manifold comprises a first supply port for receiving coolant from an engine or radiator, and a first return port for returning coolant to the engine or radiator. The manifold also has a second supply port in fluid communication with the first supply port, and a second return port in fluid communication with the first return port. Further, the manifold can have a third supply port in fluid communication with the first supply port, and a third return port in fluid communication with the first return port. The coolant manifold can further have one or more internal flow paths that are configured so that coolant flow rate or pressure exiting one supply port is different from the coolant flow rate or pressure exiting from another supply port, pre-selected based upon the thermal requirements of the heat source or heat sink components.

9 Claims, 11 Drawing Sheets

(51) Int. Cl.
*F01P 11/04* (2006.01)
*F01N 3/023* (2006.01)
*F01N 5/02* (2006.01)

(58) Field of Classification Search
CPC .... F01P 3/205; F01P 3/20; F01P 11/08; F01P 2060/10; F01P 2060/18; F01P 3/02; F01P 7/16; F01P 9/00; F01P 9/02; F01P 11/04; F01P 3/12; F16L 39/005; F01N 3/0234; F01N 5/02
USPC ... 123/543, 553, 547, 196 AB, 41.01, 41.02, 123/41.09, 41.21, 4.29, 41.54, 41.1, 123/41.31, 41.44, 41.72
See application file for complete search history.

(56) References Cited

U.S. PATENT DOCUMENTS 4,495,928 A * 1/1985 Cook ..... F02M 31/16 123/557
4,836,445 A * 6/1989 Okada ..... B60H 1/032 237/12.3 C
5,611,392 A * 3/1997 Malecek ..... F01P 3/20 123/142.5 R
5,617,815 A 4/1997 Spies et al.
5,884,587 A 3/1999 Ichihara
6,186,127 B1 2/2001 Everingham
6,196,166 B1 3/2001 Yonezawa
6,415,602 B1 * 7/2002 Patchett ..... B01D 53/90 60/274
6,668,764 B1 12/2003 Henderson et al.
6,843,210 B2 1/2005 Engelin et al.
6,978,742 B2 12/2005 Miyagawa et al.
7,168,398 B2 * 1/2007 Ap ..... F01P 7/165 123/41.1
7,343,882 B2 3/2008 Pipkorn et al.
7,444,962 B2 11/2008 Engelin et al.
7,516,737 B2 4/2009 Cerabone et al.
8,181,610 B2 * 5/2012 Dipaola ..... F01P 7/165 123/41.01
8,464,668 B2 * 6/2013 DiPaola ..... F01P 7/165 123/196 AB
2003/0127076 A1 * 7/2003 Wijaya ..... B01D 35/18 123/557
2005/0000473 A1 * 1/2005 Ap ..... F01P 7/165 123/41.1
2009/0272353 A1 * 11/2009 Gates ..... F02N 19/04 123/142.5 R
2010/0139627 A1 * 6/2010 Verhein ..... F02D 19/0605 123/553
2010/0147392 A1 * 6/2010 Craddock ..... B60K 15/03 137/2
2010/0186684 A1 * 7/2010 Utsuno ..... F01N 5/02 123/41.1
2012/0168118 A1 * 7/2012 Myers ..... B60L 11/14 165/51

FOREIGN PATENT DOCUMENTS

FR EP 0301959 A1 * 2/1989 ..... F01P 7/16
FR 2841299 A1 * 12/2003 ..... F02M 31/10

* cited by examiner

COOLANT CIRCUIT MANIFOLD FOR A TRACTOR-TRAILER TRUCK

FIELD OF THE INVENTION

The present invention relates to a coolant system manifold for a tractor-trailer truck.

BACKGROUND OF THE INVENTION

Engineers devote much time and effort towards heat energy management in a vehicle engine, such as a diesel engine. Several tractor-trailer components generate extreme heat energy, and the heat must be removed and distributed to ensure optimal functioning and avoid engine and component damage. The redistributed heat can be used beneficially by for example directing the heat to components that require heat to properly function. Thus, engineers design one or more cooling systems that distribute heat that otherwise might damage the engine and various truck components.

Diesel engines are typically cooled with a liquid coolant, such as water with an additive to prevent freezing and corrosion in the engine and cooling system. While the surplus heat must be conducted away from the engine, an efficiently designed coolant system diverts some of the surplus heat to a number of heat sinks, which utilize the heat. For example, in one diesel tractor-trailer vehicle engine system, the coolant is supplied to heat sinks such as a fuel filter heater and a cab heater. Moreover, some tractor-trailer vehicle engine systems have additional heat sources, such as a diesel exhaust fluid injector. Each of these heat sinks or heat sources traditionally is independently interconnected to the engine block of the diesel engine cooling system with a supply and return lines (pipes and/or hoses). Thus, multiple pipe or hose connections are required, and many feet of pipe or hose must be run through the engine compartment of the tractor-trailer.

The use in conventional diesel engine cooling systems of separate cooling systems and plumbing for each thermal component can increase the costs of the system, the weight of the truck, and the maintenance required to replace hoses or pipe on a frequent basis due to wear and tear caused by rubbing, vibration, heat, etc. Fuel economy can be negatively impacted. Further, optimal flow may not be achieved in such a manner, as components optimally require differing amounts of coolant flow for proper functioning. Consequently, improvements in such cooling systems are needed.

SUMMARY OF THE INVENTION

The following presents a simplified summary of the invention in order to provide a basic understanding of some aspects of the invention. This summary is not an extensive overview of the invention and is not intended to identify key or critical elements of the invention or to delineate the scope of the invention. The purpose of this section is to present some concepts of the invention in a simplified form as a prelude to the more detailed description that is presented later.

A tractor-trailer truck engine coolant manifold as described herein can comprise a first supply port for receiving coolant from an engine or radiator, and a first return port for returning coolant to the engine or radiator. The manifold can also have a second supply port in fluid communication with the first supply port, and a second return port in fluid communication with the first return port. Further, the manifold can have a third supply port in fluid communication with the first supply port, and a third return port in fluid communication with the first return port. The coolant manifold can further have one or more internal flow paths that are configured so that coolant flow rate or pressure exiting one supply port is different from the coolant flow rate or pressure exiting from another supply port. The coolant flow characteristics and design configurations are pre-selected based upon the thermal requirements of the heat source or heat sink components.

DETAILED DESCRIPTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art and all such alternate embodiments, modifications, and improvements are within the scope of the present invention.

Figure 1:
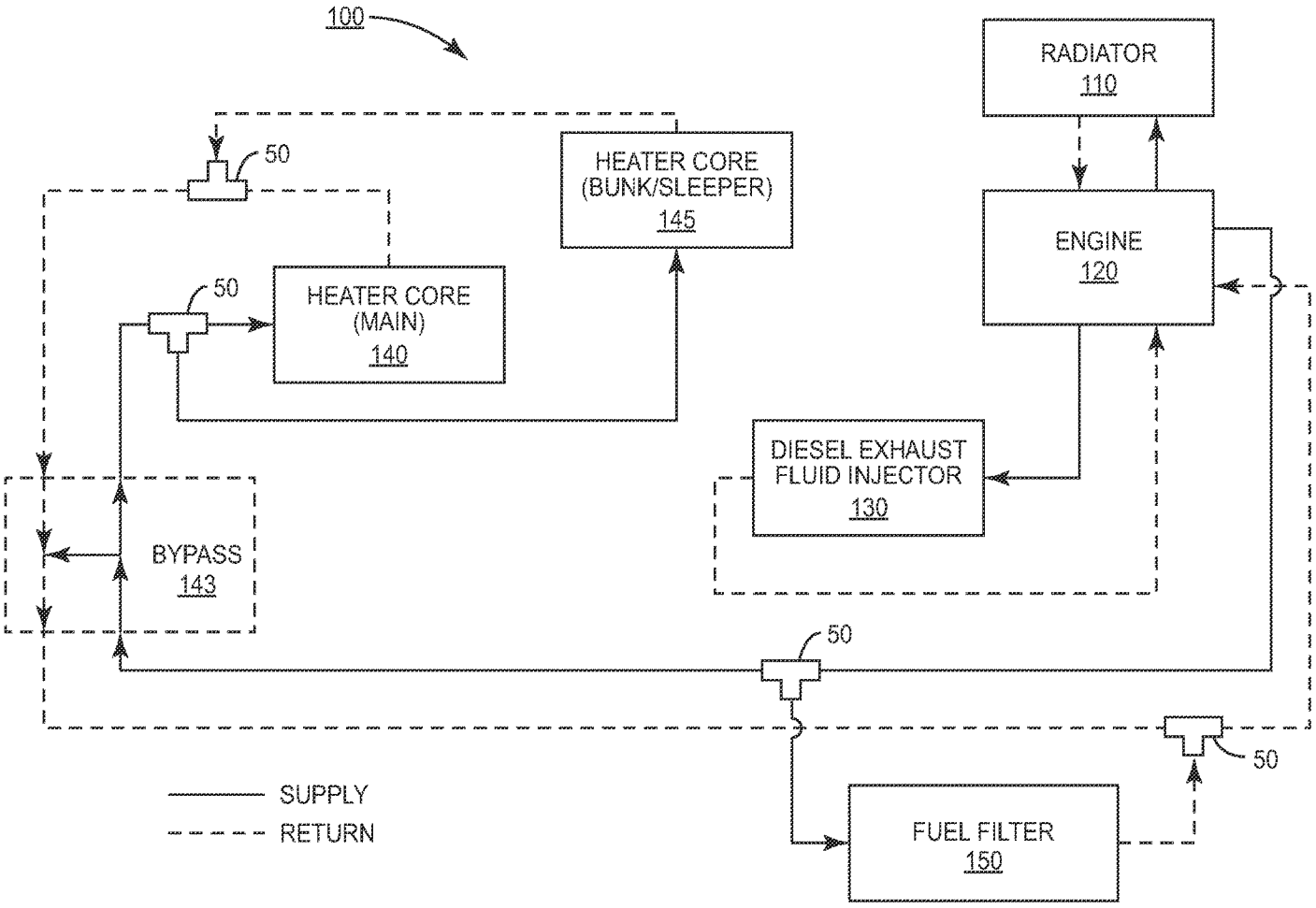
FIG. 1 (PRIOR ART)
FIG. 1 is a schematic view of a prior art coolant system for a tractor-trailer truck.

Referring first to FIG. 1, a conventional (prior art) diesel tractor-trailer truck coolant system 100 is schematically illustrated. This exemplary coolant system comprises a radiator 110, engine 120, heat source 130, and heat sinks 140 and 150. One or more pumps (not shown) or other conventional means to cause the coolant fluid to circulate within the circuit to the various components can also be provided. As used herein, the term "heat sink" refers to a component or assembly that takes heat away from supplied coolant such that the entrance coolant temperature to the component is higher than the exit coolant temperature. Heat sinks in this system generally are components that need heat to function or serve their purpose. A "heat source" works in the opposite manner, taking heat away from the component and adding it to the coolant fluid. In this exemplary coolant system 100, the components include a heat source referred to as a diesel exhaust fluid injector 130 (also known as an urea injector), and heat sinks including a heater core 140, and a fuel filter heater 150, each well known in the art. The heater core 140 may comprise a main heater unit for the cab of the truck and a second heater unit 145 for the bunk/sleeper area in the cab of the truck. A bypass circuit 143 permits coolant to avoid circulating through the heater cores during times in which cabin heat is not required. As used herein, "coolant" can be a conventional mixture of water and various additives to prevent freezing and/or corrosion, or can also include other fluids such as oil or gases capable of transferring heat by temperature or phase changes. The coolant system can also operate under various operating pressures as may result from a closed system and as dictated by system thermal requirements.

Cooling and heating of truck components is important for proper and efficient engine operation and occupant comfort. In one exemplary embodiment, the radiator 110 is responsible for removing approximately 11,380 BTU/minute of heat from the engine by way of circulated coolant. The radiator lowers the coolant temperature from about 212 F to about 198 F, at which point the coolant returns to the engine 120. The diesel exhaust fluid injector 130, as a heat source, can transfer about 30 BTU/minute to the coolant. The heater cores 140, 145 removes about 1500 BTU/minute in total, and the fuel filter heater 150 removes about 400 BTU/minute from the coolant. In order to create fluid communication between these various components, connections and fluid conduits are required. As shown, and exclusive of the radiator connections, such an arrangement requires four separate connections to the engine 120. As will be appreciated, this also requires four individual cooling sub-circuits, which must each be individually routed through the engine compartment of the truck and along the chassis frame. While conventional T-junctions 50 can minimize routing length to some extent, excessive piping and hosing can be required. In one typical configuration, approximately 65 feet of pipe and hose are required, including numerous clamps and other hardware for attaching the piping and hosing within the engine compartment and frame rail.

Figure 2:
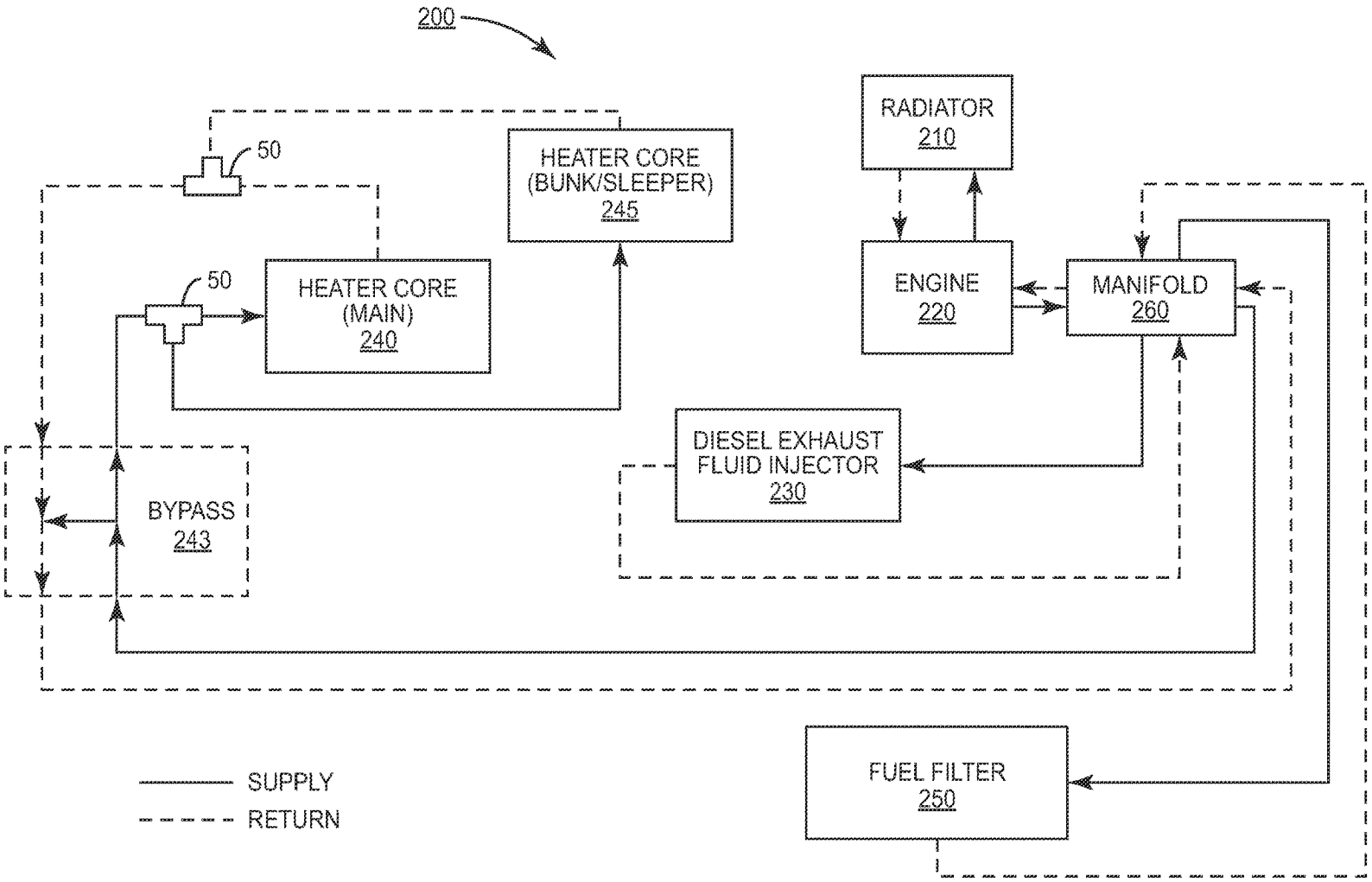
FIG. 2 is a schematic view of one embodiment of a coolant manifold of the present invention.

Turning now to FIG. 2, a first embodiment of the vehicle coolant system 200 of the present invention is schematically illustrated. In this embodiment, the coolant system comprises an engine 220, a radiator 210, a diesel exhaust fluid injector 230, a heater core 240, a bunk heater 245, a fuel filter heater 250, and a coolant manifold 260. As used herein, the term "manifold" refers to a chamber or compartment having one or more inlets and a plurality of outlets to distribute a fluid. A heater bypass 243 is also available to selectively control flow to the heater cores. As shown, the use of the coolant manifold 260 of the present invention reduces the number of connections to the engine to two, versus the four connections of the prior art coolant system of FIG. 1. In the embodiment shown in FIG. 2, the length of hose and pipe is reduced from about 65 feet of pipe and hose to about 50 feet of pipe and hose. This also has been found to reduce the cost per typical vehicle by about $100 U.S. dollars. Use of the manifold 260 also eliminates many of the fasteners and hardware that were previously required to attach the coolant system hoses and pipes within the truck. Additionally, this more compact configuration reduces the weight of the coolant system by about 3.5 pounds, which in turn results in fuel savings. Calculations indicate that such savings can be as much as 400 gallons of fuel over the service life of a truck.

Figure 3:
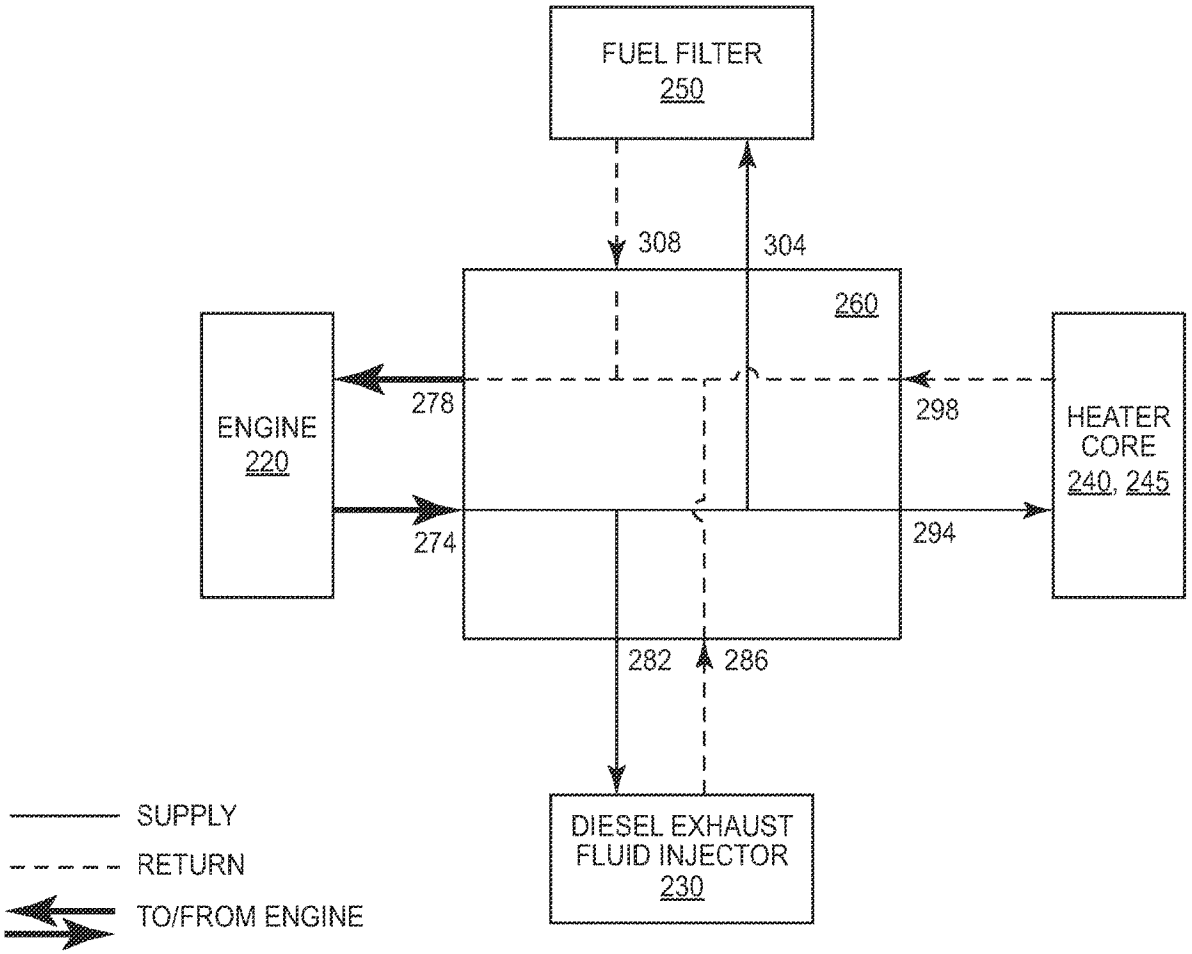
FIG. 3 is a schematic view of the coolant manifold of FIG. 2.

FIG. 3 shows schematically the coolant flow paths within the manifold 260. The supply line of coolant from the engine 220 enters the manifold 260 at supply port 274. (While this embodiment shows the manifold 260 in fluid communication with the engine 220, the manifold could alternatively be in fluid communication directly with the radiator 110.) This coolant flow then branches in the manifold 260, resulting in multiple exit ports to different components. In the embodiment shown, the coolant leaves the manifold 260 via exit port 304, which provides coolant to the fuel filter heater 250. The coolant also leaves via exit port 282, which provides coolant to the diesel exhaust fluid injector 230. Also, the coolant leaves via exit port 294 on its way to the heater cores 240, 245. The return lines similarly rejoin at the manifold 260 prior to returning to the engine 220 via exit port 278. The coolant returns from the fuel filter heater 250 via port 308. The coolant returns from the heater core 240 via port 298. The coolant from the diesel exhaust fluid injector 230 returns via port 286.

Figure 4:
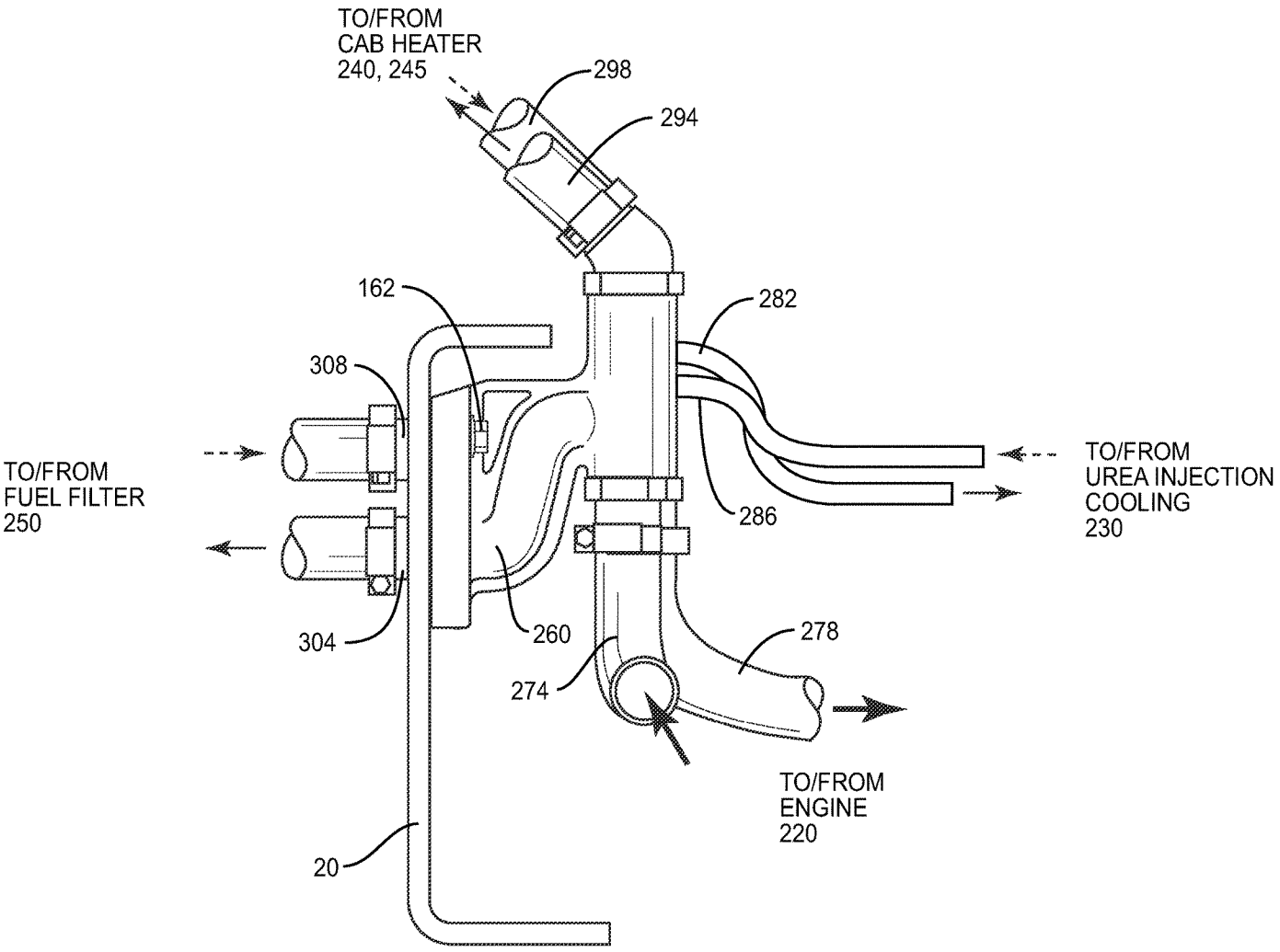
FIG. 4 is a front environmental view of a coolant manifold, as installed in the tractor-trailer truck engine compartment.
Figure 5:
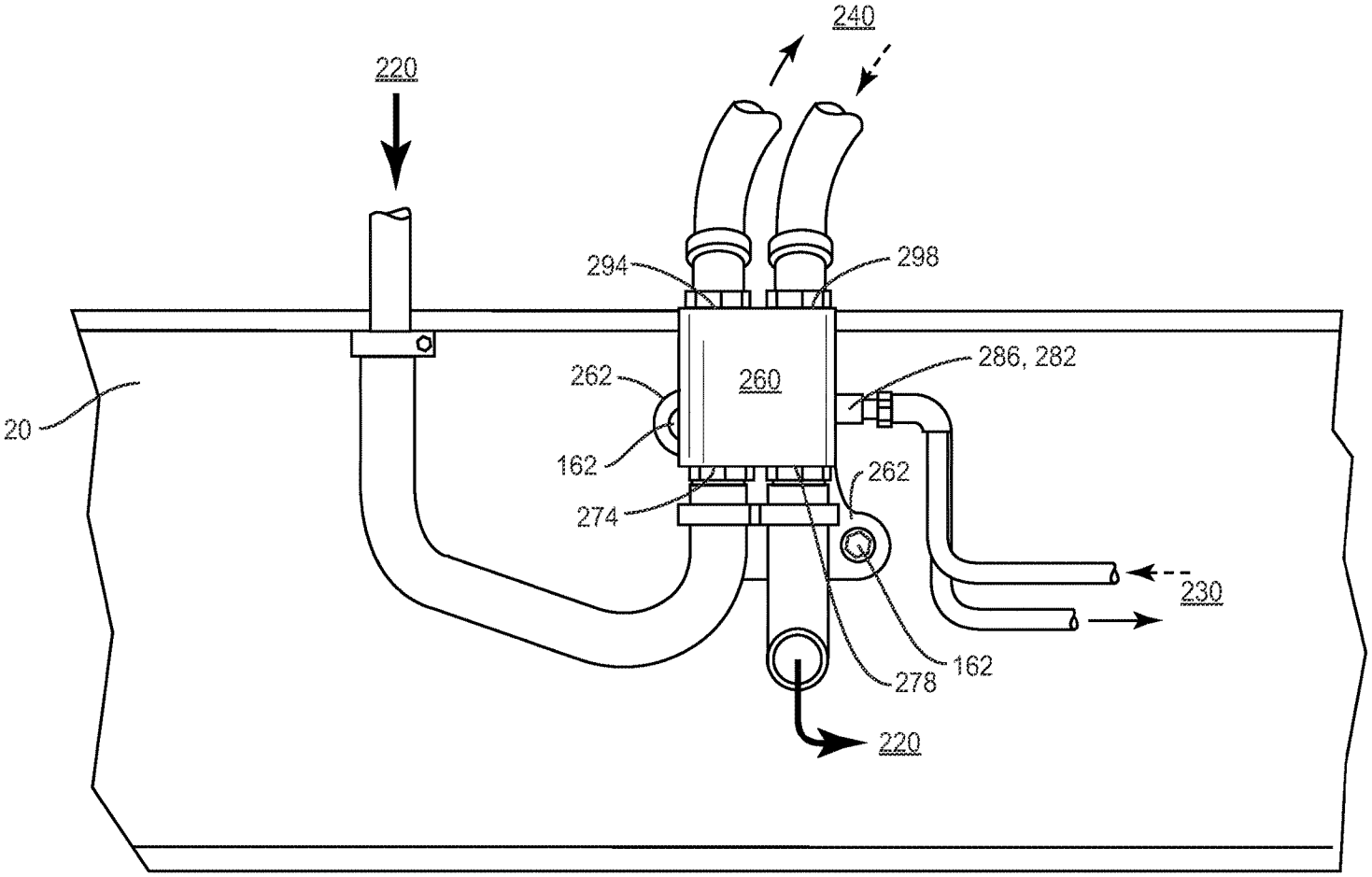
FIG. 5 is a side perspective environmental view of the coolant manifold of FIG. 4, as installed in the tractor-trailer truck engine compartment.

FIGS. 4 and 5 are a front view and side view, respectively, illustrating in one embodiment the manner in which a coolant manifold 260 is installed within an engine compartment of a diesel tractor-trailer truck. Such trucks typically have two longitudinally extending frame members, which support most major truck components. In a preferred embodiment, the coolant manifold 260 is attached to one U-profiled longitudinal side member, or frame rail 20, of the truck chassis frame within the engine compartment. The coolant manifold 260 may be attached to the frame 20 with conventional fasteners, such as bolts 162. In the embodiment shown, the bolts 162 extend through flanges 262 extending along the sides of the coolant manifold 260. As described above, various ports provide supply and return coolant to the heat sources or heat sinks within the system. The coolant manifold 260 provides for efficient distribution of coolant to and from the engine 220, while reducing the length of hose/piping, the number of fasteners, and the number of connections to the engine 220. The various ports of the manifold 260 are shown in FIGS. 4 and 5, as well as the intended heat source or sinks served by the ports.

Figure 6:
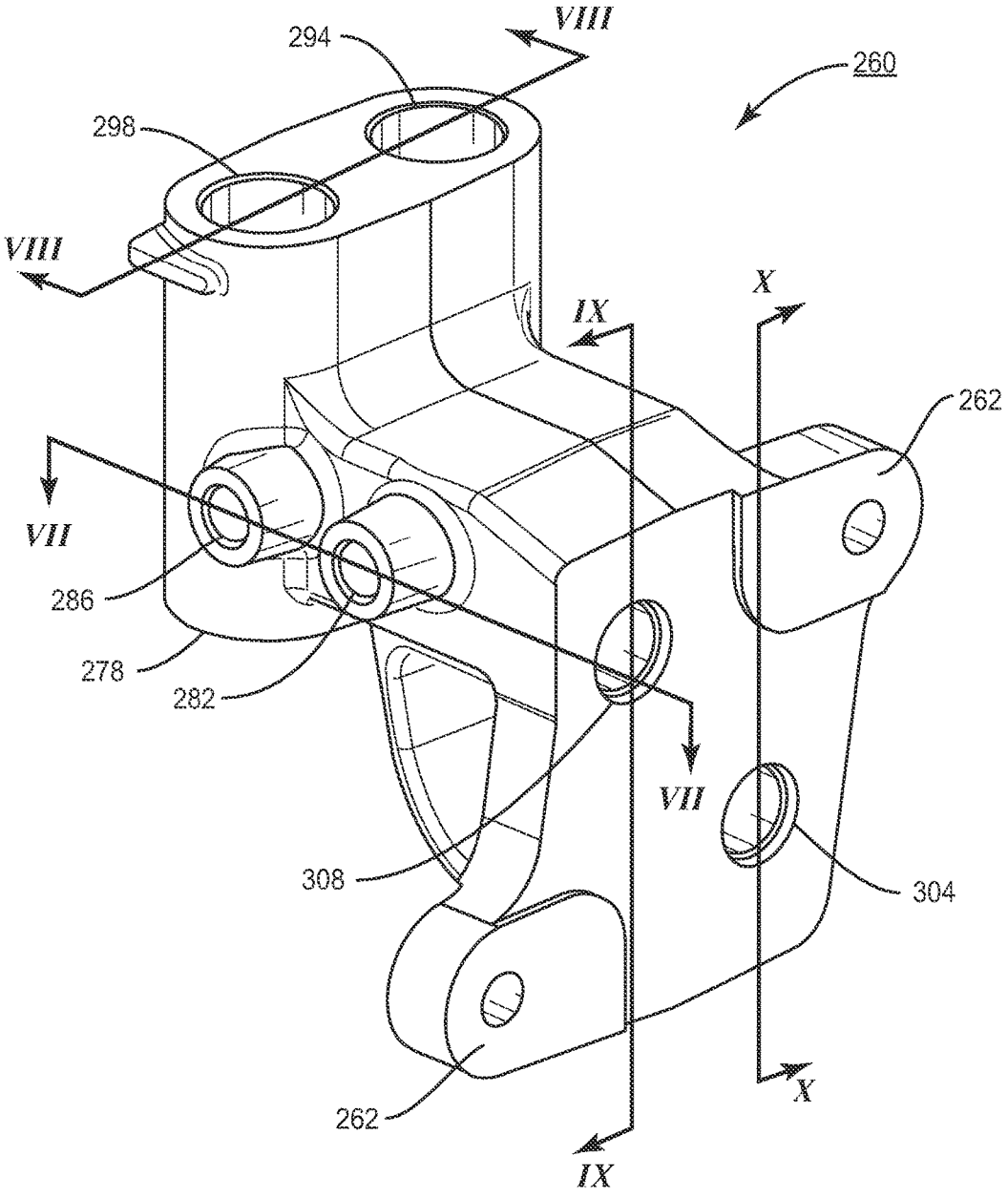
FIG. 6 is a first perspective view of an embodiment of the coolant manifold of the present invention.

FIG. 6 shows an exemplary embodiment of the coolant manifold 260 without certain supplemental hardware such as fittings or connectors. As shown, this embodiment of the coolant manifold 260 is formed as a unitary cast body. The inventors have found that the coolant manifold may be formed from cast aluminum ASTM B 108, A356.0-T61, which is capable of handling temperatures of up to about 1250 degrees Fahrenheit, which is more than the expected coolant temperature upper end of less than 230 degrees F. As will be appreciated by those of ordinary skill in the materials arts, the coolant manifold 260 may be cast from other materials, such as iron, steel, brass, and magnesium. Further, the coolant manifold need not be unitary; rather, it may be formed of multiple pieces attached together in such a manner to ensure the fluid and pressure requirements of the hot and cooled coolant. A manifold made of multiple sub-assemblies, however, may experience greater internal pressure differentials than a unitary counterpart.

As shown in the embodiment of FIG. 6, the coolant manifold 260 comprises an engine coolant return port 278, a diesel exhaust fluid injector supply port 282, a diesel exhaust fluid injector return port 286, a heater core supply port 294, a heater core return port 298, a fuel filter heater supply port 304, and a fuel filter heater return port 308. An engine supply port 274, shown in FIG. 8, is not visible in FIG. 6.

Figure 7:
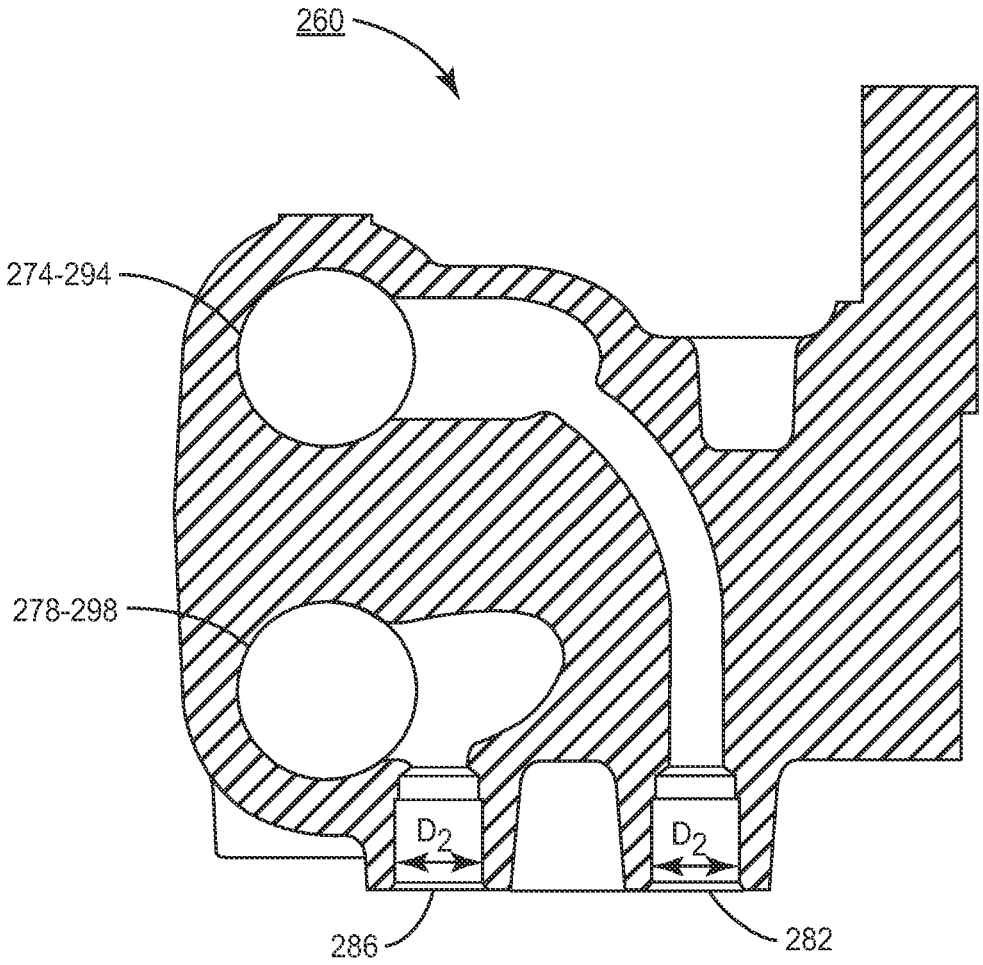
FIG. 7 is section taken along Line VII-VII of the embodiment of FIG. 6.

The design of the manifold 260 permits optimal sizing of the internal conduits and orifices to achieve desired flow characteristics for the heat source and/or heat sink components. Various cross sections of the manifold 260 are shown in FIGS. 7-10, which reveal internal proportional dimensions. For example, as shown in FIG. 7, the internal conduit 274-294 serving engine coolant supply port 274 and heater core supply port 294, is in fluid communication with the diesel exhaust fluid injector supply port 282. Also, an internal conduit 278-298 that connects engine coolant return port 278 to heater core return port 298 is in fluid communication with diesel exhaust injector return port 286. In this embodiment, the diesel exhaust fluid injector supply port 282 and diesel exhaust fluid injector return port 286 are each approximately 0.37 inches in diameter, D2, but may range in diameter between about 0.35 inches to about 0.39 inches. The dimensions are preselected based upon cooling system needs. The compact design of the coolant manifold ensures an efficient supply and return of the required engine coolant flow to the diesel exhaust fluid injector 230. In the embodiment shown, the diesel exhaust fluid injector supply port 282 and diesel exhaust fluid injector return port 286 are dimensioned to accept and return approximately 4% of the total flow, or about 1 gallon of coolant flow per minute.

Figure 8:
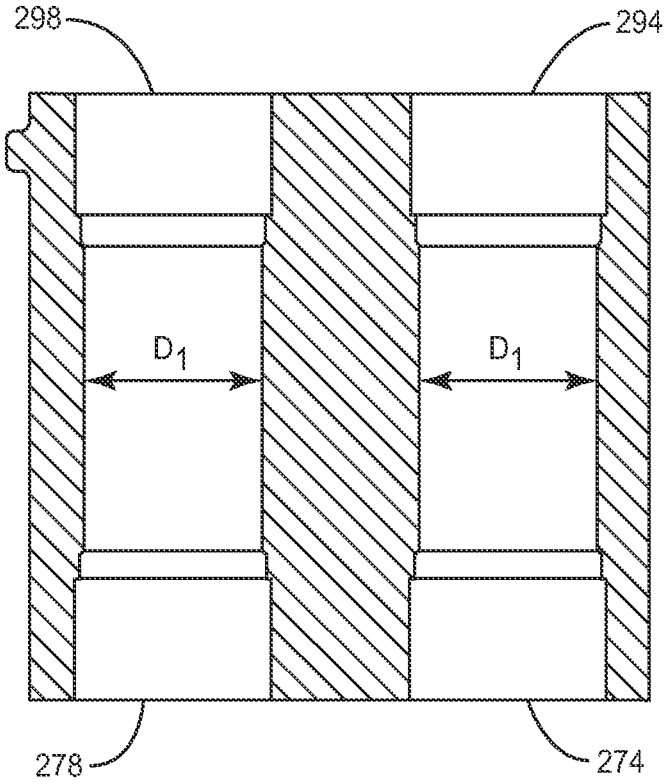
FIG. 8 is a section taken along Line VIII-VIII of the embodiment of FIG. 6.

In FIG. 8, the pre-selected similar dimensions of engine coolant supply port 274 and the engine coolant return port 278 are shown. The internal fluid conduits permitting fluid communication between ports 274 and 294, and ports 278 and 298, have only minimal restrictions generally throughout their length, due to coolant flow requirements of the heater cores 240, 245. In one embodiment, the engine coolant supply port 274 and the engine coolant return port 278 are dimensioned for approximately 20 gallons of coolant per minute. In this embodiment, the engine coolant supply port 274 and the engine coolant return port 278 are approximately 0.87 inches in diameter, D1, but may range in diameter between about 0.81 inches to about 0.93 inches, Extending directly through the body of the coolant manifold 260, the engine coolant supply port 274 and the engine coolant return port 278 are in fluid communication, respectively, with the heater core supply port 294 and heater core return port 298, having similar dimensions.

Figure 9:
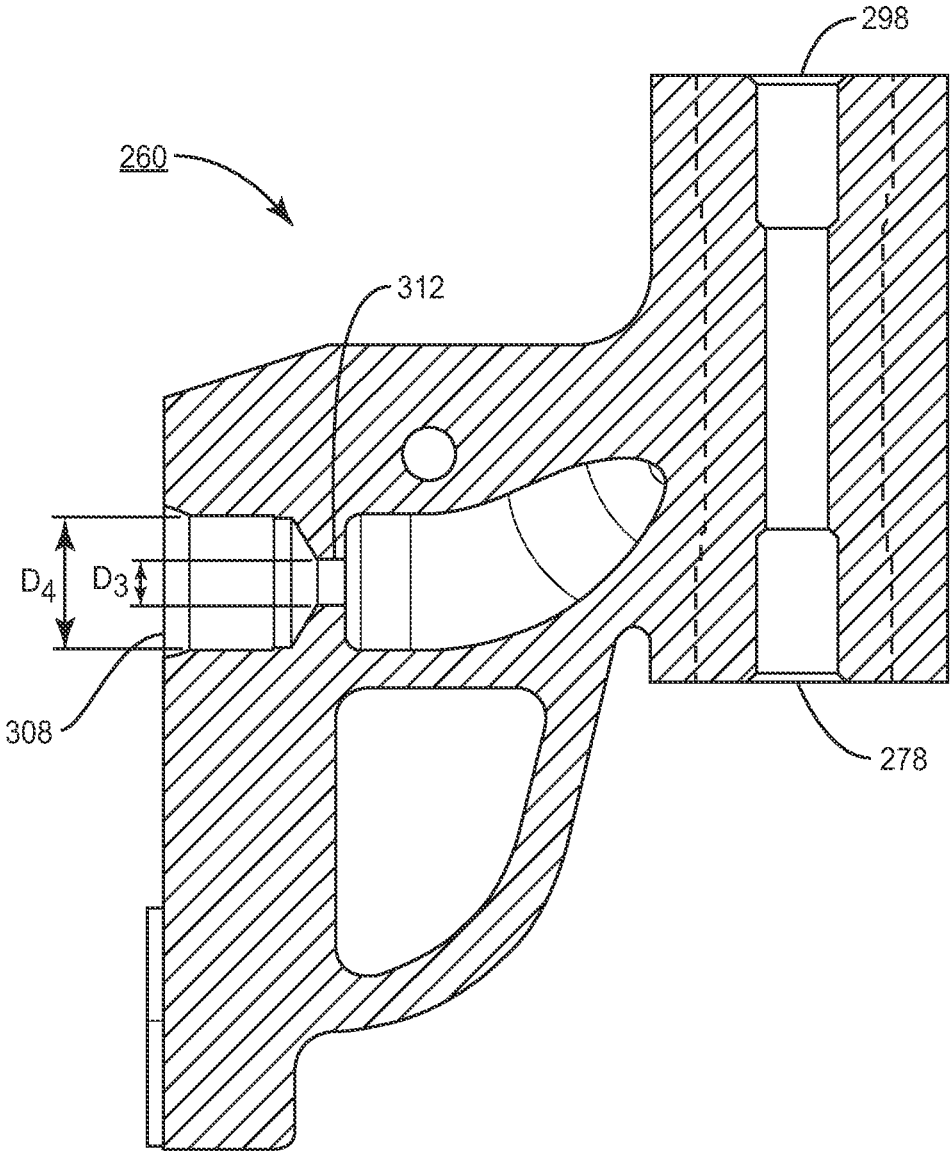
FIG. 9 is a section taken along Line IX-IX of the embodiment of FIG. 6.
Figure 10:
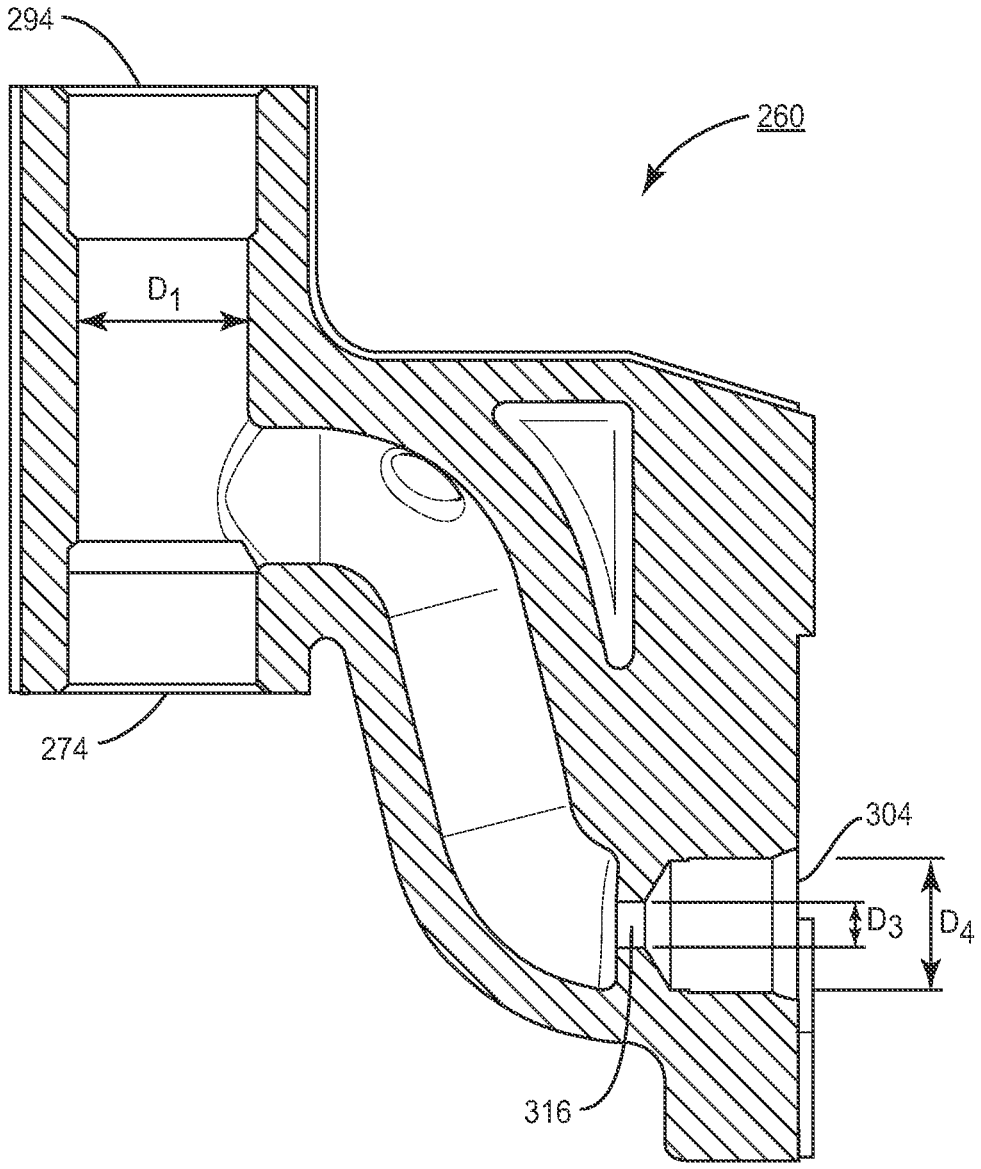
FIG. 10 is a section taken along Line X-X of the embodiment of FIG. 6.

The internal conduits servicing ports 304 and 308 utilize pre-selected flow restrictors. These ports provide fluid connections to the fuel filter heater 250. As shown in FIGS. 9 and 10, restrictive flow orifices 312 and 316 are provided to limit the supply and return flow to the fuel filter heater 250 to approximately about 20% of the total flow, or about 3 gallons of coolant flow per minute to and from the fuel filter heater 250. Since it was found that coolant flow to the fuel filter heater was excessive with the conventional tractor-trailer truck coolant system, the inventors have found that the restrictive flow orifices will substantially reduce flow to and from the fuel filter heater 250, while still providing sufficient heat transfer. The flow was reduced by 50% to bring it within 8% of optimized flow at truck engine idle condition. In one embodiment, the fuel filter heater 250 supply port 304 and the fuel filter heater return port 308 are each approximately 0.67 inches in diameter, and the restrictive flow orifices 312, 316 are each approximately about 0.24 inches in diameter, D3, but the fuel filter heater 250 supply inlet 304 and filter heater supply outlet 308 may range in diameter between about 0.61 inches to about 0.73 inches, and the restrictive flow orifices 312 and 316 may range in diameter between about 0.23 inches to about 0.25 inches.

Figure 11:
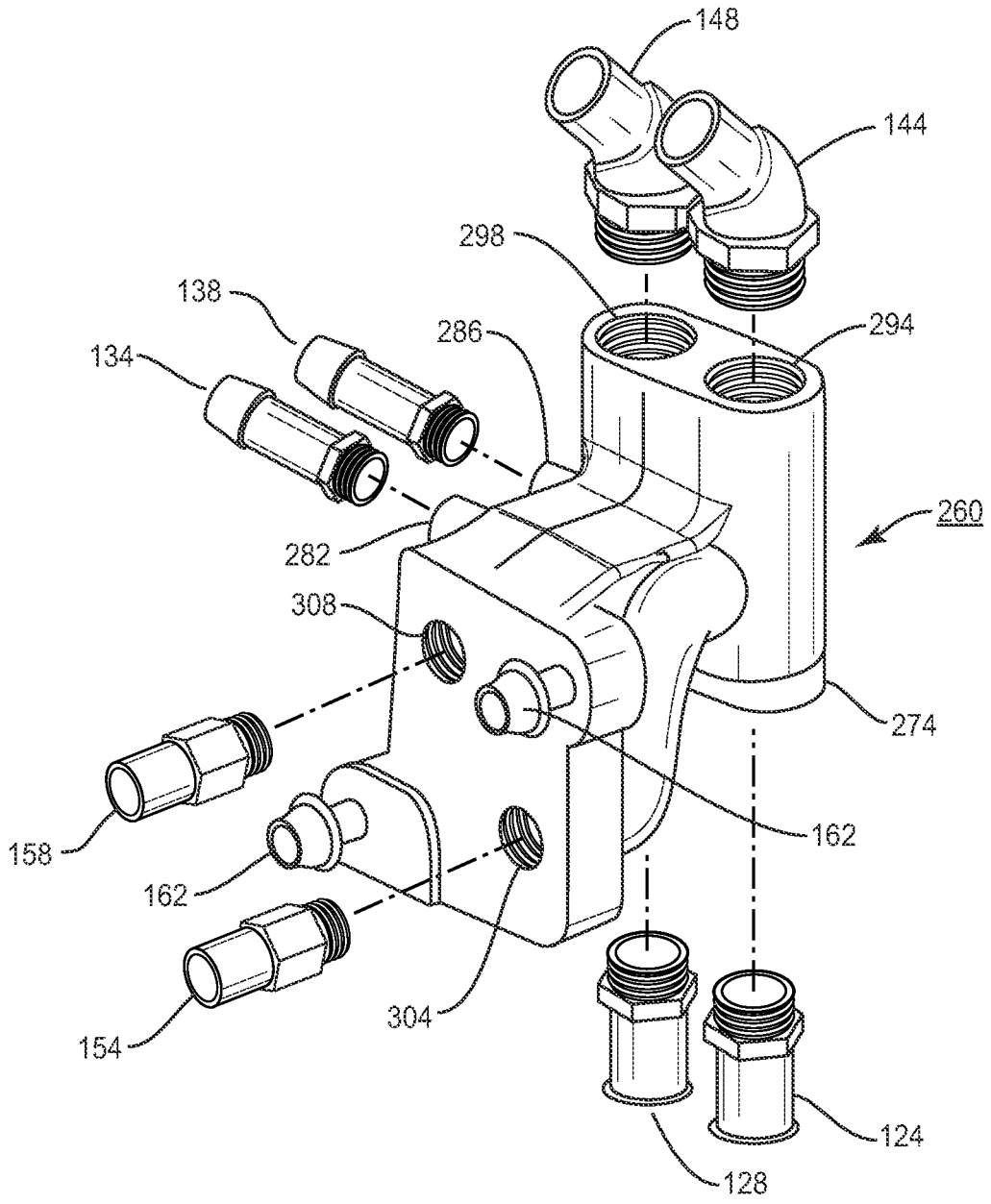
FIG. 11 is an exploded second perspective view of an embodiment of a coolant manifold of the present invention.

Turning lastly to FIG. 11, an exploded view of the coolant manifold 260 is shown with optional fittings for interconnecting the coolant manifold 260 with the engine 220, diesel exhaust fluid injector 230, heater cores 240, 245, and fuel filter heater 250. As shown, pluralities of threaded connector fittings are provided, although the fittings need not be threaded. With respect to the engine coolant supply port 274 and engine coolant return port 278 (shown in FIGS. 5 and 6), threaded fittings 124 and 128 are provided. With respect to the diesel exhaust fluid injector supply port 282 and diesel exhaust fluid injector return port 286, threaded fittings 134 and 138 of the type shown are provided. For the heater core supply port 294 and heater cores return port 298, threaded fittings 144 and 148 of the type shown are provided. Lastly, with respect to the fuel filter heater supply port 304 and fuel filter heater return port 308, threaded fittings 154 and 158 are provided. In one embodiment, each of the fittings is formed from brass material, although different materials may be use.

With respect to flow performance, the design of the coolant manifold is such that those components requiring greater flow are supplied via larger-scaled and less restrictive flow paths, and those components requiring less flow are supplied with more restrictive pathways. Therefore, where the prior art cooling circuit layout allotted excessive flow to components unnecessarily, the manifold circuit layout of this invention has redistributed those flows to optimize the overall cooling system. In other words, the diesel exhaust filter receives ample cooling, the heater cores operate in an optimal range, and the fuel filter receives target and pre-selected flow rates.

It will be understood and appreciated by those of ordinary skill in the art that the coolant manifold and vehicle coolant system of the present invention may comprise more or less supply ports and return ports. For example, for some diesel truck models there is no requirement for a heater fuel filter; thus, the coolant manifold need only be formed with a engine coolant supply port, a engine coolant return port, a heater core supply port, a heater core return port, a diesel exhaust fluid supply port, and a diesel exhaust fluid return port. Conversely, it is foreseen that the coolant manifold may be configured to supply and return coolant to and from additional heat sources and sinks. In addition and as mentioned above, a coolant manifold of the type described can be directly connected to the radiator, as opposed to the engine block, and still efficiently deliver coolant to the necessary heat sinks and/or heat sources. Other arrangements are possible, such as the coolant coining to the manifold 260 from the radiator 210, and then the return exiting from the manifold 260 and directly to the engine 220, or vice versa. In any such arrangements, primary and secondary pumps (not shown) could be at various locations as needed in the circuit.

The above descriptions of preferred embodiments of the invention are intended to illustrate various aspects and features of the invention without limitation. Persons of ordinary skill in the art will recognize that certain changes and modifications can be made to the described embodiments without departing from the scope of the invention. All such changes and modifications are intended to be within the scope of the appended claims. Features from one embodiment or aspect may be combined with features from any other embodiment or aspect in any appropriate combination. For example, any individual or collective features of method aspects or embodiments may be applied to apparatus, product or component aspects or embodiments and vice versa.

I claim:

1. A tractor-trailer truck engine coolant manifold for circulating a coolant within a circuit, the manifold comprising:

a manifold body having a supply flow path and a return flow path, the supply flow path having no connection with the return flow path in the manifold body;

a supply inlet port formed on the manifold body and connected to the supply flow path;

a first exit port formed on the manifold body and connected by a first supply branch to the supply flow path;

a second exit port formed on the manifold body and connected to a second supply branch to the supply flow path;

a return exit port formed on the manifold body and connected to the return flow path;

a first return inlet port formed on the manifold body and connected to a first return branch to the return flow path; and a second return inlet port formed on the manifold body and connected to a second return branch to the return flow path.

2. The coolant manifold of claim 1, further comprising:

a third exit port formed on the manifold body and connected to a third supply branch to the supply flow path; and a third return inlet port formed on the manifold body and connected to a third return branch to the return flow path.

3. The coolant manifold of claim 1, wherein the first supply branch and the second supply branch are configured so that a coolant volumetric flow exiting the first exit port is different from a coolant volumetric flow exiting the second exit port.

4. A coolant system for a vehicle having an engine, a radiator, a first heat source, and a first heat sink, each having at least one passageway capable of having coolant pass there through and having a supply port and a return port in fluid communication as part of a cooling circuit, the system comprising:

a manifold body having an internal supply flow path and an internal return flow path, the supply flow path having no connection with the return flow path in the manifold body;

a supply inlet port formed on the manifold body and connected to the supply flow path and connected to receive coolant from an engine or a radiator and guide it to the supply flow path;

a first exit port formed on the manifold body and connected by a first supply branch to the supply flow path to guide coolant from the supply flow path to one of the first heat source and first heat sink;

a second exit port formed on the manifold body and connected by a second supply branch to the supply flow path to guide coolant from the supply flow path to another of the first heat source and first heat sink;

a return exit port formed on the manifold body and connected to the return flow path and connected to the engine or the radiator to guide coolant from the return flow path to the engine or the radiator;

a first return inlet port formed on the manifold body and connected by a first return branch to the return flow path to guide coolant from one of the first heat source and first heat sink to the return flow path; and a second return inlet port formed on the manifold body and connected by a second return branch to the return flow path to guide coolant from the other of the first heat source and first heat sink to the return flow path.

5. The coolant system of claim 4, wherein the first heat source is an engine exhaust fluid injector, the first exit port is connected to an engine exhaust fluid injector supply port, and the first return port is connected to an engine exhaust fluid injector return port.

6. The coolant system of claim 4, wherein the first heat sink is a heater core, the second exit port is connected to a heater core supply port, and the second return port is connected to a heater core return port.

7. The coolant system of claim 4, wherein the vehicle includes a second heat sink having an inlet port and a return port, the manifold body comprising a third exit port connected by a third supply branch to the supply flow path and connected to the second heat sink inlet port, and a third return port connected by a third return branch to the return flow path and connected to the second heat sink return port.

8. The coolant system of claim 7, wherein the second heat sink is a fuel filter heater.

9. The coolant manifold of claim 4, wherein the first exit port is in fluid communication with a first heat source or heat sink component and the second exit port is in fluid communication with a second heat source or heat sink component, and wherein the first supply branch the second supply branch are configured so that a first coolant volumetric flow exiting the first exit port is different from a second coolant volumetric flow exiting the second exit port, the first and second coolant volumetric flows being configured according to thermal requirements of the components.

* * * * *